US005335806A

United States Patent [19]

Dedoes

[11] Patent Number: 5,335,806

[45] Date of Patent: Aug. 9, 1994

[54] ADAPTER RING FOR A PAINT CAN

[75] Inventor: John Dedoes, Brighton, Mich.

[73] Assignee: Dedoes Industries, Inc., Walled Lake, Mich.

[21] Appl. No.: 84,635

[22] Filed: Jun. 29, 1993

[51] Int. Cl.[5] ..... B65D 53/02

[52] U.S. Cl. ..... 220/358; 220/287; 220/729; 220/733; 220/354

[58] Field of Search ..... 220/358, 287, 378, 655, 220/729, 733, 308, 354

[56] References Cited

U.S. PATENT DOCUMENTS

| | | | |
|---|---|---|---|
| 3,894,650 | 7/1975 | Crump | 220/733 X |
| 4,084,525 | 4/1978 | Booth | 220/614 X |
| 4,111,330 | 9/1978 | Jordan | 220/306 |
| 4,149,578 | 4/1979 | Hickey | 220/378 X |
| 4,228,916 | 10/1980 | Weingardt | 220/354 |
| 4,386,715 | 6/1983 | Morton | 220/354 |
| 4,969,570 | 11/1990 | Harvey, Sr. | 220/733 |
| 5,059,319 | 10/1991 | Welsh | 220/354 X |
| 5,174,464 | 12/1992 | Watt | 220/256 |

*Primary Examiner*—Allan N. Shoap
*Assistant Examiner*—Vanessa Caretto
*Attorney, Agent, or Firm*—Gifford, Groh, Sprinkle, Patmore and Anderson

[57] ABSTRACT

The present invention provides an adapter for use in-conjunction with a paint can having an opening at one end and an inwardly extending rim adjacent the open end of the can. A continuous groove is provided around the rim and this groove has a preset width and a preset depth. The adapter includes an annular body which is dimensioned to be insertable into the can groove and to form a seal between the adapter and the paint can rim. The precise dimension of the body may vary between different can manufacturers. An annular channel is provided around an outwardly facing side of the body and this channel is adapted to receive and sealing engage a sealing flange on a standardized lid for the can.

2 Claims, 1 Drawing Sheet

ADAPTER RING FOR A PAINT CAN

BACKGROUND OF THE INVENTION

I. Field of the Invention

The present invention relates to an adapter to enable a standardized lid to be used with different-sized cans.

II. Description of the Prior Art

Conventional paint cans typically comprise a tubular cylindrical casing having an opening at one end. An inwardly extending rim is provided adjacent the open end of the paint can and this rim includes an annular and inwardly extending groove. This groove is adapted to cooperate with the sealing flange on the lid provided with the paint can.

In many operations, however, it is impractical to repeatedly remove the lid provided with the paint can and, after use, replace the paint can lid provided with the paint can. For example, in automotive body shops it is necessary that paint of many different colors be mixed and ready for application without any appreciable time delay. The time required to remove the paint can lid provided with the paint can, mix the paint and thereafter replace the paint can lid unacceptably increases labor cost.

Consequently, many body shops and the like use paint mixing equipment having a plurality of shelves in a rack which supports paint cans of different colors. Additionally, the conventional lid of the paint can is replaced by a substitute lid having both a stirring element and a spout. Upon insertion of the paint can into the paint can rack, mechanical means engage the stirring element so that the paint in the paint cans is continuously mixed or stirred while the can is positioned in the rack. Thus, when paint in the can is required, the paint can is removed from the rack with this lid, dispensed through the dispenser on the lid and then replaced within the rack so that mixing of the paint continues.

One difficulty in manufacturing paint mixing equipment of the type used in body shops is that there is little standardization of the size of the paint can rims even for the same quantity of paint, e.g. quart size or gallon size. Thus, a quart size paint can from two different manufactures may have different size rims. This is particularly true in Europe where liter paint cans are employed and there is virtually no standardization from one country to the next.

Consequently, in order to provide paint mixing equipment capable of accepting cans from different paint manufacturers, it has been previously required to separately manufacture a different paint can lid with the mixing element and dispensing spout for each different manufacturer. Typically, these lids include a sealing flange which extends into the paint can opening and is secured in place by locking feet. The size of the sealing flange, however, still varies from one manufacturer to the next.

The previously known requirement of separately manufacturing different lids for different manufactures increases the overall costs of the paint mixing equipment.

SUMMARY OF THE PRESENT INVENTION

The present invention provides an adapter which overcomes all the above mentioned disadvantages of the previously known paint mixing equipment.

In brief, the adapter includes an annular body which is dimensioned to be insertable into the can groove. Thus, the precise shape and dimensions of the annular body will vary from one paint can manufacturer to the next.

An annular channel is provided around the outwardly facing side of the annular body. The diameter and shape of the annular channel, however, is substantially the same regardless of the particular adapter so that a standardized lid having a sealing flange dimensioned to be received within the annular channel can be used with each different adapter.

Consequently, even though a plurality of different adapters are required to accommodate paint cans having different size rims, once the adapter is positioned within the can groove, a standardized lid can be utilized to accommodate the paint cans from different manufacturers.

The rims are preferably inexpensively manufactured from plastic and are preferably of a one piece construction.

BRIEF DESCRIPTION OF THE DRAWING

A better understanding of the present invention will be had upon reference to the following detailed description, when read in conjunction with the accompanying drawings, wherein like reference characters refer to like parts throughout the several views, and in which.

DETAILED DESCRIPTION OF PREFERRED EMBODIMENTS OF THE PRESENT INVENTION

Figure 1:
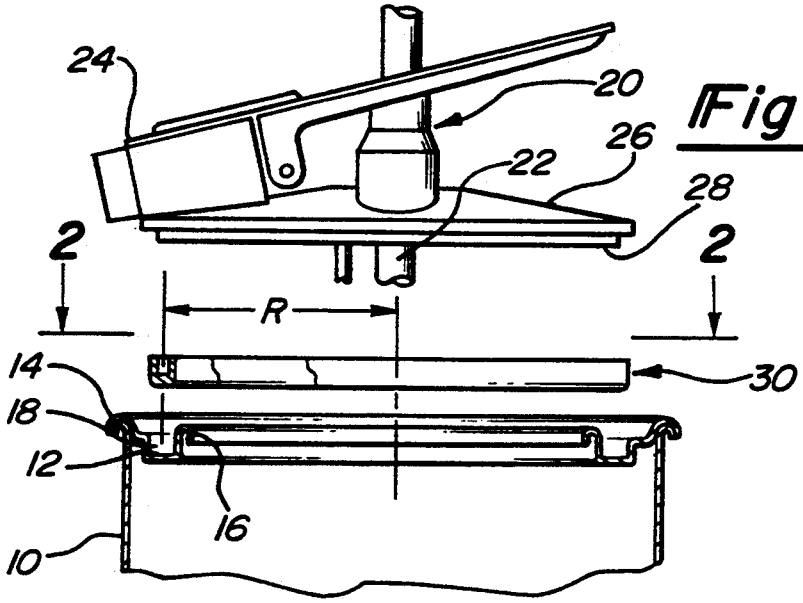
FIG. 1 is a fragmentary exploded view illustrating a preferred embodiment of the present invention.

With reference first to FIG. 1, a conventional paint can 10 includes a radially inwardly projecting rim 12 at its upper end 14. This rim 12 forms a circular opening 16 through which the paint in the can is dispensed.

The paint can rim 12 includes a generally U-shaped groove 18 which faces outwardly from the upper end 14 of the paint can 10. This U-shaped groove 18 normally receives the sealing lip on the paint can lid (not shown) provided by the manufacturer of the paint can.

Still referring to FIG. 1, in certain applications, such as automotive repair shops, the lid for the paint can 10 is removed, disgarded and replaced with a new paint lid 20 having both a stirring element 22 (only a portion of which is illustrated) as well as a dispensing spout 24. The lid 20 also includes a generally circular cover portion 26 having a downwardly projecting annular lip 28. The replacement lid 20 can be constructed of a metallic material, such as zinc, or of non-metallic materials, such as plastic.

In order to obtain proper operation of the replacement lid 20, it is necessary that the lip 28 on the lid 20 sealingly engage the U-shaped groove 18 on the paint can rim 12. Unless proper sealing is obtained between the lip 28 and rim 12, paint solvent evaporation as well as leakage while dispensing the paint from the can occurs.

Figure 3:
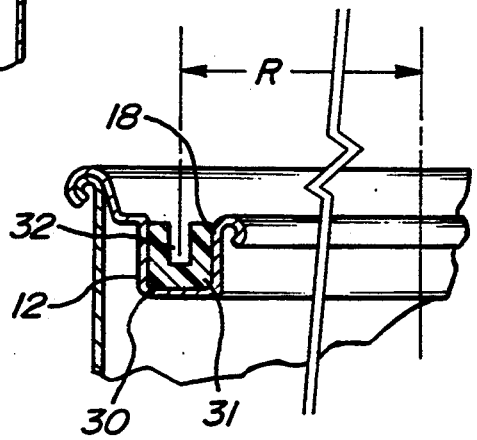
FIG. 3 is a partial sectional fragmentary view illustrating a preferred embodiment of the present invention.
Figure 4:
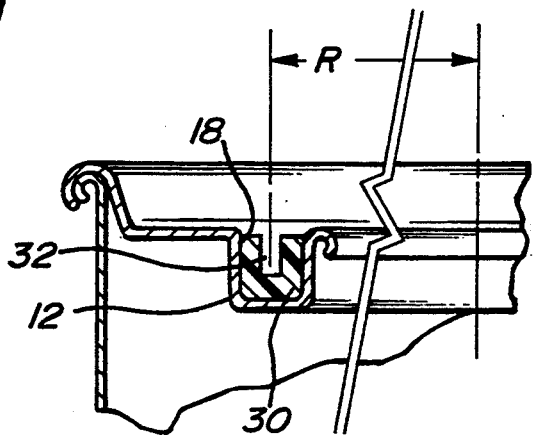
FIG. 4 is a view similarly to FIG. 3 illustrating another embodiment of the present invention.

As best shown in FIGS. 3 and 4, there is little standardization of the precise size of the rim 12 or of its U-shaped groove 18. For example, in FIG. 3, the U-shaped groove 18 is spaced more radially outwardly from the center of the can 10 than the U-shaped groove 18 of the paint can illustrated in FIG. 4. Consequently, it has not been previously possible to use a single replacement lid 20 for different paint cans from different manufacturers, even though the paint cans are of the same liquid quantity, e.g. quart size or gallon size.

Figure 2:
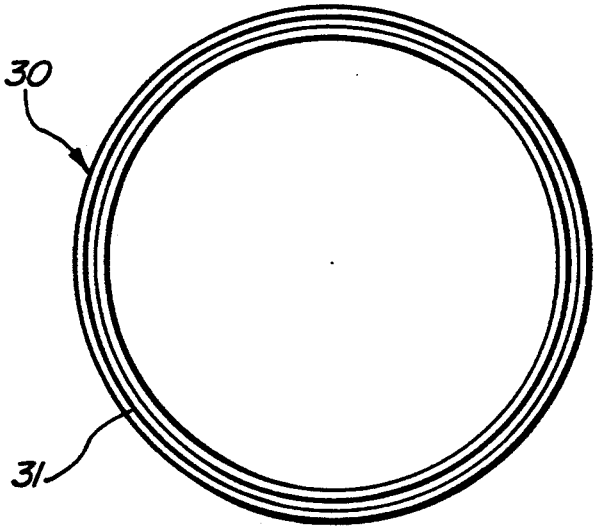
FIG. 2 is plan view taken substantially along line 2—2 in FIG. 1.

With reference now to FIGS. 1–3, in order to overcome this problem, the present invention provides an adapter 30 having an annular body 31 which is dimensioned to be insertable into the groove 18 of the paint can rim 12. As best shown in FIG. 3, the adapter 30 is generally U-shaped in cross action thus having an upwardly facing channel 32. This channel 32 is at a predetermined distance R with respect to the center of the ring 30 and this distance R corresponds with the radius of the lip 28 on the replacement lid 20.

Consequently, with the adapter 30 positioned in the channel 18 as shown in FIG. 3, the adapter ring 30 not only sealingly engages with the can rim 12, but also sealingly engages the lip 28 on the lid 20 when the lid 20 is attached to the top 14 of the paint can 10.

With reference now to FIGS. 3 and 4, it will, of course, be apparent that different adapters 30 and 30′ (FIG. 4) are necessary to accommodate paint cans having different rims 12 as frequently occurs with paint cans from different paint can manufacturers. However, in each case, the upwardly extending groove 32 in the adapter ring is at a predetermined distance R with respect to the center of the ring. Consequently, a seal is still formed between the adapter ring 30 or 30′ when using the same substitute lid 20.

The adapter 30 is preferably made of a synthetic material, such as plastic, for both low cost manufacture and also for its resilient qualities which enhances the seal between the lid 20 and the adapter 30. Other materials, however, can alternatively be used.

Even though it is necessary to manufacture different adapters for different paint can specifications, substantial cost savings are achieved since a single substitute lid 20 can be used with numerous different paint can manufacturers. It is much less expensive to manufacture different adapter rings 30 for different paint can manufacturers than to manufacture different substitute lids 20 for different paint can manufacturers due to the complexity of the paint can lid 20.

Having described my invention, however, many modifications thereto will become apparent to those skilled in the art to which it pertains without deviation from the spirit of the invention as defined by the scope of the appended claims.

I claim:

1. In combination:

a standardized lid of the type used in automatic paint stirring equipment, said lid having a downwardly depending annular flange, said flange having a preset radial width and preset diameter, at least two different paint cans, each can having an open top with an annular and upwardly facing rim circumscribing said open top, said rims being generally U-shaped in cross section thus having an outer radial wall and an inner radial wall, wherein the radii of the inner and outer radial walls for one paint can differs from the radii of the inner and outer radial walls for the other paint can, at least two annular adapter rings, each adapter ring having an inner and outer radial side and being generally U-shaped in cross section and having an upwardly facing channel, said channel in each ring having said preset radial width and said preset diameter so that said channel sealingly receives said annular flange on said standardized lid, wherein the radii of said inner and outer radial sides of one adapter ring corresponds to the radii of the inner and outer walls of the rim of one paint can while the radii of said inner and outer radial sides of the other adapter ring corresponds to the radii of the inner and outer walls of the rim of the other paint can.

2. The invention as defined in claim 1 wherein each said adapter ring as of a one piece plastic construction.

* * * * *